US005503273A

United States Patent [19]

Fiebig et al.

[11] Patent Number: 5,503,273

[45] Date of Patent: Apr. 2, 1996

[54] FOLDING BOX FOR RETAINING A FLUORESCENT LAMP HAVING MULTIPLE PARALLEL U-SHAPED DISCHARGE VESSELS

[75] Inventors: Werner Fiebig; Horst Gedack, both of Munich, Germany

[73] Assignee: Patent-Treuhand-Gesellschaft F. Elektrische Gluehlampen mbH, Munich, Germany

[21] Appl. No.: 326,768

[22] Filed: Oct. 20, 1994

Related U.S. Application Data

[62] Division of Ser. No. 60,886, May 12, 1993, abandoned, which is a continuation of Ser. No. 837,850, Feb. 18, 1992, abandoned.

[30] Foreign Application Priority Data

Apr. 4, 1991 [DE] Germany ..... 9104096 U
Apr. 4, 1991 [DE] Germany ..... 9104097 U

[51] Int. Cl.[6] ..... B65D 85/42

[52] U.S. Cl. ..... 206/418; 206/493

[58] Field of Search ..... 206/418, 419, 206/420, 491, 492, 493

[56] References Cited

U.S. PATENT DOCUMENTS 3,910,409 10/1975 Fortlage ..... 206/418 X
3,968,924 7/1976 Tyrseck ..... 206/418 X
4,903,836 2/1990 Combs ..... 206/418 X
5,005,705 4/1991 Combs ..... 206/419 X

*Primary Examiner*—Jacob K. Ackun
*Attorney, Agent, or Firm*—Frishauf, Holtz, Goodman, Langer & Chick

[57] ABSTRACT

To securely retain a multi-unit folded fluorescent lamp (L) having a gap (20*d*, 21*d*) between adjacent legs of the lamp in position in an elongated box (1'), the box is formed from a blank (1) having a top panel (15) which overlies an intermediate panel (16) of lesser width than the top panel, from which at least a first retention flap (19*a*) extends in a first gap between the two legs of the lamp. A second retention flap (19*b*) is cut, along a severing line (19*c*), from the intermediate panel element (16) and folded along a fold or crease line (21) to fit into the gap between other legs of the discharge vessel or discharge vessel unit of the lamp. The retention flaps (19*a*, 19*b*) retain the lamp and support the legs in case of vibration or shock due to transport. Preferably, a protective flap (9) extends from the bottom panel (2) at a position further away from the terminal end of connecting pins (11, 11') projecting from the base (12) of the lamp, the protective flap (9) being folded back against the pins (11, 11') to protect them and additionally protect the lamp against damage due to axial shocks.

7 Claims, 5 Drawing Sheets

FOLDING BOX FOR RETAINING A FLUORESCENT LAMP HAVING MULTIPLE PARALLEL U-SHAPED DISCHARGE VESSELS

This is a divisional application of U.S. Ser. No. 08/060,886, filed May 12, 1993, abandoned, and which is a continuation of U.S. Ser. No. 07/837,850, filed Feb. 18, 1992, and now abandoned.

FIELD OF THE INVENTION

The present invention relates to a unitary folding box, and more particularly to a shipping and display carton, for a folded fluorescent lamp having two or more pairs of U-shaped discharge vessels, with a connection base for the lamp at one end.

BACKGROUND

Boxes for compact fluorescent lamps or other folded fluorescent lamps of generally U-shaped construction, in which the legs of the U are essentially parallel to each other are known, see for example Combs U.S. Pat. No. 4,903,836. Boxes of this type are used not only for shipping packages, but also for display of fluorescent lamps in which the discharge vessel is bent upon itself, with the legs of the U forming a comparatively narrow gap between each other. The cartons are intended to prevent damage to the lamps during shipment, storage and display, while also permitting, at least to a limited extent, inspection of the lamps upon sale.

The known carton as described in the Combs U.S. Pat. No. 4,903,836 has a flap element which engages between the legs of the U in order to prevent the lamp from falling out of the carton when an end closure is opened, or towards the end where the base is located. In use, it has been found that such cartons or containers, usually made out of cardboard, are suitable only for very small or compact fluorescent lamps. If the lamps are elongated, for example having an overall longitudinal dimension of more than 12" (30 cm), and particularly for 20" (50 cm) or longer fluorescent lamps, protection by such a type of carton has been found to be inadequate. Drop and vibration tests have shown that the long legs of U-shaped fluorescent lamps are subject to oscillations which, under some conditions, may cause the legs to oscillate, leading to breakage at the cross connection of the legs.

The connection pins at the bases of the lamps usually extend from the package, at least to some extent, to permit testing while still in the package. The pins are not sufficiently protected against damage, due to bending, blows and the like.

The light output of U-shaped fluorescent lamps can be increased by placing a plurality of U-shaped discharge vessels next to each other, retained in a common base. Thus, without appreciable increase in space requirement of a fixture, the light output of such a lamp can be doubled. Such lamps are particularly subject to breakage because cross connections are formed between the respective pairs of legs at opposite ends of the legs. The packaging should provide support for all the legs of the U-shaped fluorescent lamps, regardless of the number of pairs of legs, or number of discharge vessel units which are used.

THE INVENTION

It is an object to provide a unitary box, that is, a box folded from a single blank, suitable as a package for multiple-unit single-ended U-shaped fluorescent lamps, which provides better protection for the packaged lamp than prior art structures, and which is readily adapted for use with multi-unit U-shaped discharge vessels.

Briefly, the package, when erected and folded, has essentially rectangular elongated box shape. It is a unitary cardboard element. The box forms a bottom panel having a width covering or spanning all of the legs of the lamp, a top panel of essentially similar width, that is, covering or spanning all the legs of the lamp. Two side panels are located at the respective lateral sides of the box, extending at essentially right angles with respect to the top panel and the bottom panel. The box further includes an intermediate panel element which extends parallel to the top panel, but has a width which is less than the width of the top panel.

A plurality of retention flaps, unitary with the intermediate panel and folded along respective crease lines off the intermediate panel, extend at an angle therefrom and project between legs of the discharge vessel, to prevent the discharge vessel from falling out of the box.

The retention flaps are formed by cuts or severing incisions along severing lines, of essentially U shape from the intermediate panel element, leaving a connection to the intermediate panel element, which connection defines a fold or crease line. The flaps are bent about the crease line, away from the intermediate panel, so that they will extend between two of the legs of the discharge vessels. Preferably, one retention flap, at least, is provided for each of the units of a two-unit U-shaped lamp, each fitted in the gap between the two legs of the respective U-shaped discharge vessel. The retention flap acts as a cushion between the legs of the discharge vessel. Thus, danger of breakage during transport of the lamps is substantially decreased.

The dimensions of the retention flaps are preferably matched to the dimensions of the gap between the legs of any one of the U-shaped discharge vessels, or between adjacent legs of the discharge vessels. Preferably, the retention flaps are not positioned precisely vertically with respect to the intermediate panel or, in other words, are not exactly parallel to the side walls. Rather, they are so arranged that they form an angle with respect to the side walls, so that each retention flap engages both legs of the corresponding U-shaped discharge unit or units. Such an arrangement has the advantage that the thickness of the retention flaps need not be matched to, or arranged to be precisely the thickness of the gap between the legs of the U-shaped discharge vessel legs, in order to obtain the cushioning effect of the respective retention flaps.

The retention flaps can be located, preferably, approximately intermediate the length of the discharge vessel units to clamp the discharge vessel securely in position in the folded box. This effectively suppresses vibration of the legs of the discharge vessel and substantially increases the protection which the lamps receive by its packaging box.

In accordance with a feature of the invention, an additional protective extension flap is provided at the ends of the box where, in use, the base of the lamp is located, in order to protect the connecting pins of the base of the lamp. The protective flap is bent off from the top or bottom wall, backwardly upon itself, but permitting resilient engagement against the contact pins of the base and thereby prevents damage to the contact pins upon axial impacts or shocks applied against the lamp.

The bottom wall or bottom panel of the lamp box, preferably, is formed with a few cut-outs, forming viewing windows, to permit customers and sales personnel to look at the lamp and confirm its integrity in the package, as well as the design, and electrical data thereof. Rather than cutting out the viewing windows, the side walls may be formed with severing cuts which provide for additional flaps permitting further positioning of the lamp within the box and reducing the play of the lamp within the box, when packaged.

The box is closed by closing flaps, fitting in suitable slits formed on the top wall of the box. This permits unfolding of the box, for example to test the lamp, and reclosing without difficulty. Additional viewing windows can be formed where desired, to permit viewing by the customer, for example at the back or bottom wall.

DRAWINGS

DETAILED DESCRIPTION

Figure 1A:
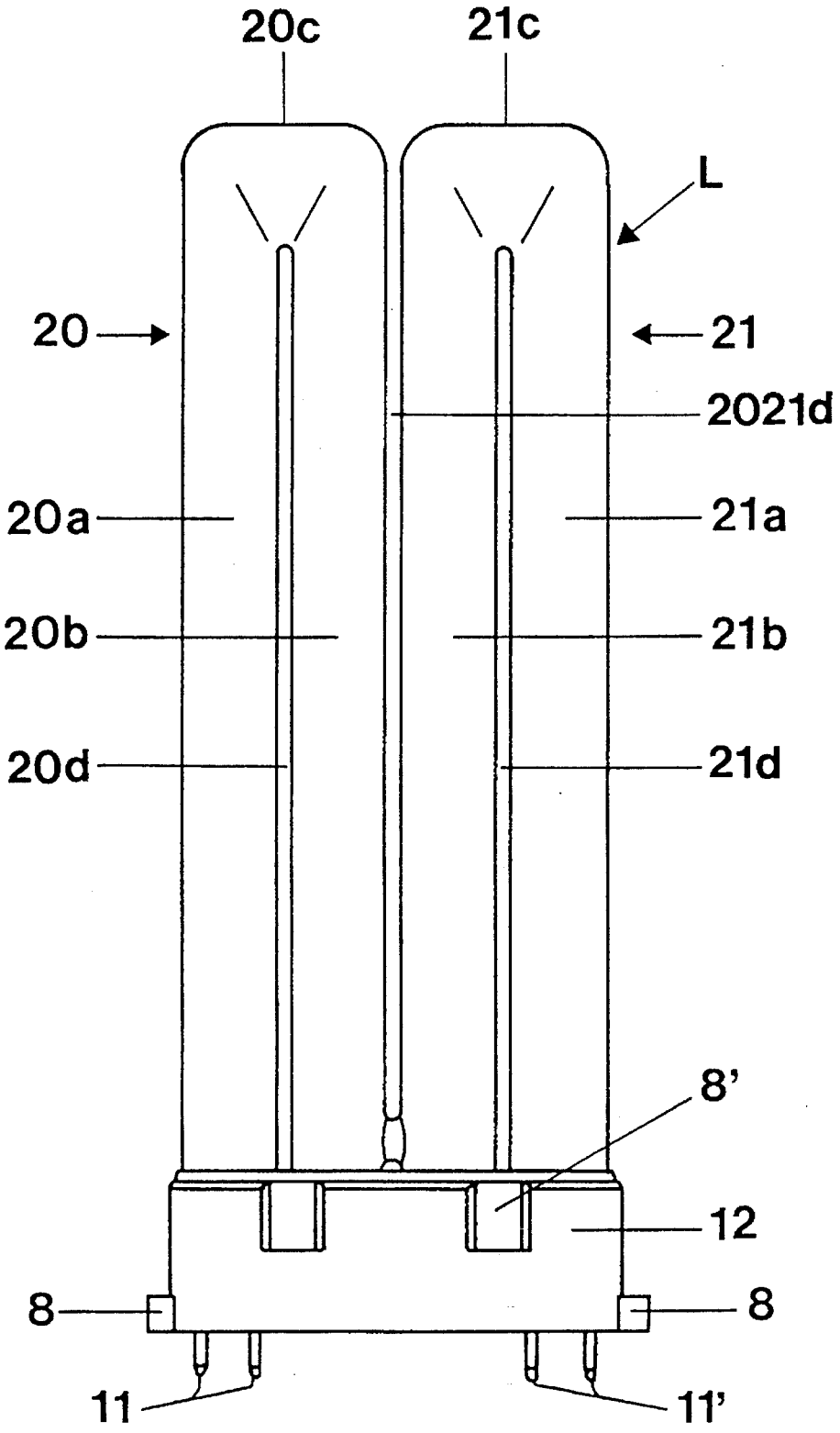
FIG. 1A is a plan view of a dual U discharge vessel fluorescent lamp.
Figure 1B:
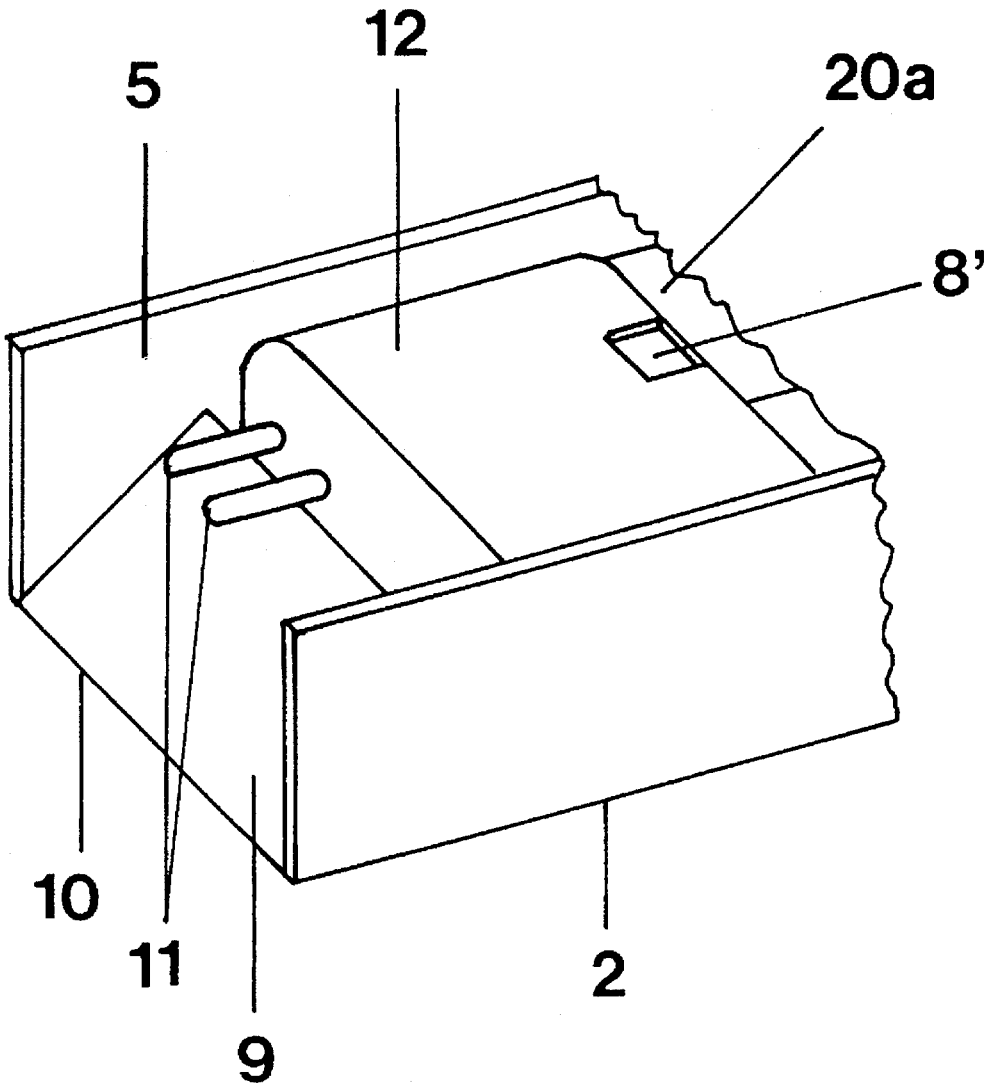
FIG. 1B is a fragmentary view of the base of the lamp in the box.

FIG. 1 illustrates a multi-unit lamp L. The lamp L has two U-shaped discharge vessel units 20, 21, each having legs 20*a*, 20*b*, 21*a*, 21*b* connected by end or connecting portions 20*c*, 21*c*. The legs of the lamp units 20, 21 are separated by gaps 20*d*, 21*d*, and the adjacent legs 20*b*, 21*b* are, in turn, separated from each other by a gap 2021*d*. The lamp has a base 12, formed with locating projections 8 and recesses 8'. Connection pins 11, 11' extend from the base 8.

Figure 2A:
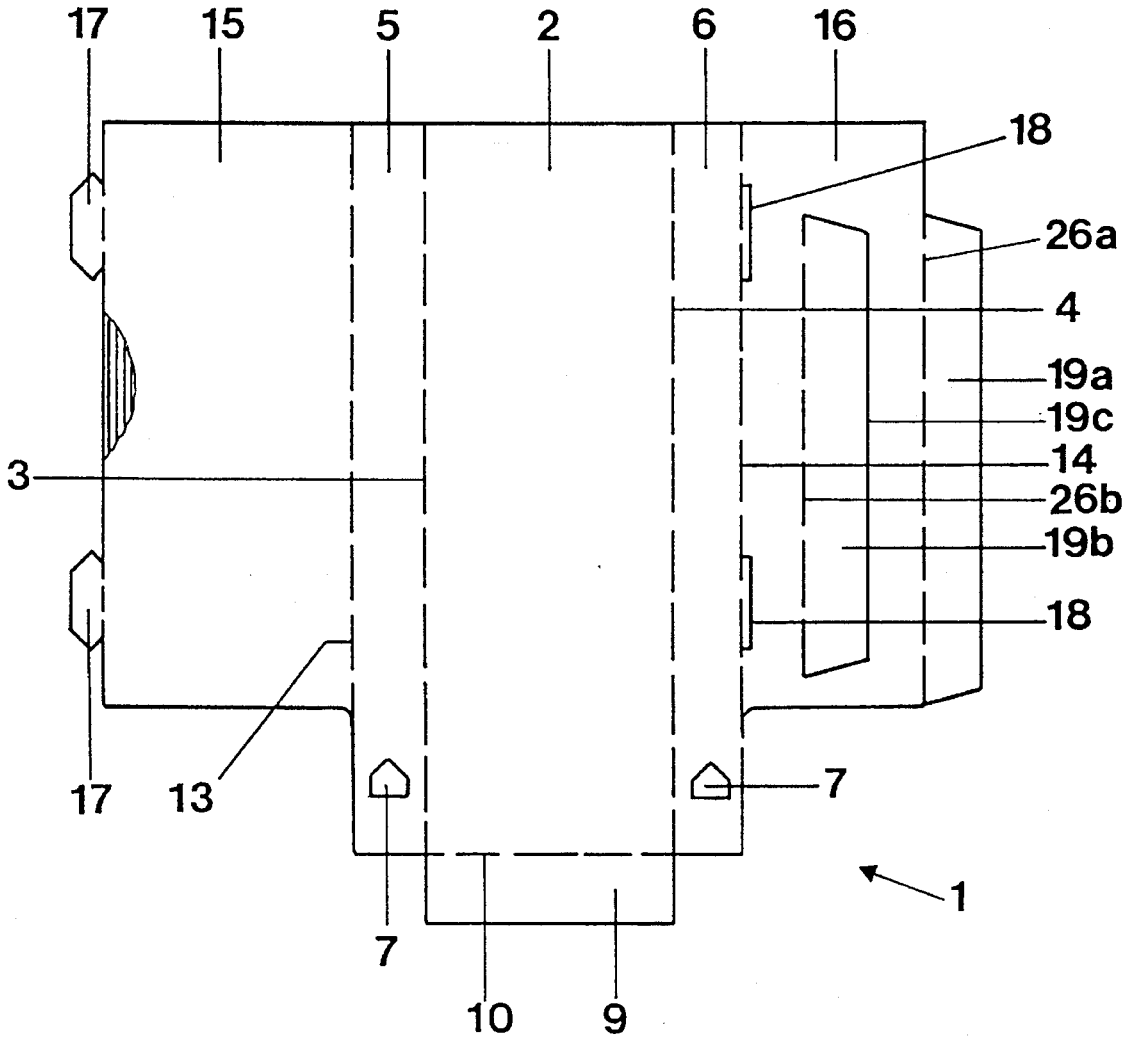
FIG. 2A is a top view of a folding blank for the lamp of FIG. 1.
Figure 2B:
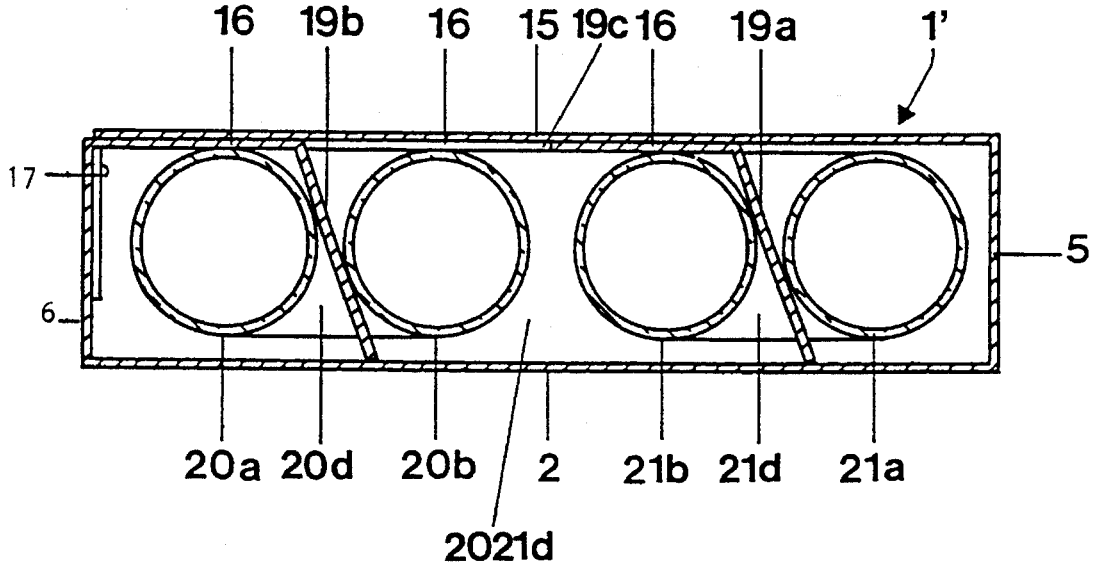
FIG. 2B is a cross section through the folded box, with the lamp of FIG. 1 schematically shown therein.

Referring now to FIGS. 2A and 2B:

The blank 1 is made of a unitary, that is, single-element corrugated cardboard material, of about 1.7 mm thickness. The direction of corrugations is axial, that is, parallel to folding edges or folding creases in the box to be formed. When the blank 1 is erected or folded to construct the box 1' the box will have essentially rectangular cross section, see FIG. 2B. The box 1' has a length of about 240 mm, a width of about 83 mm, and a height of about 22 mm. The construction of the box is best seen by reference to FIG. 2B.

The unitary cardboard blank 1 is divided into side wall panels 5, 6, a bottom wall panel 2, and a top panel 15. The respective panels or wall panels are angled off from each other. Fold or crease lines 3, 4 connect the back wall 2 to the side walls 5, 6. The side walls or side wall panels 5, 6 are formed with cut-outs 57, so that data or coding of the lamp can be seen when the lamp L is retained within the box. This coding is characteristic to the lamp, and determined by the position and size of the locating projections 8 (see FIG. 1A).

The side wall panel 5 is connected to the top panel 15 by a crease or fold line 13. The side wall panel 6 is connected by a crease or fold line 14 to an intermediate panel element 16. The top panel 15 and the intermediate panel element 16, together, form the top wall of the box, when erected, see FIG. 2B. Both the top panel 15 and the intermediate panel element 66 are foreshortened with respect to the side walls 5, 6 and are only about 19 cm long. This leaves the lamp 12 at least partly visible. Two connecting or closing tabs 17 are formed on the top panel 15. The connecting or closing tabs 17 fit into matching slits 18 adjacent the crease line 14 on the intermediate panel element 16.

In accordance with a feature of the invention, the intermediate panel 16 is formed with two retention flaps 19*a*, 19*b* which fit in the gaps 21*d*, 20*d*, respectively, between the legs 21*a*, 21*b* and 20*a*, 20*b* of the respective U-shaped discharge units 40, 41—see FIG. 2B. The retention flap 19*a* is folded at a crease or fold line 26*a* located at an outer edge of the intermediate panel element 16. The retention flap 19*b* is cut along an incision line 19*c* from the intermediate panel element 16, and folded off the intermediate panel 16 along a fold or crease line 26*b*. The length of the retention flaps 19*a*, 19*b* roughly corresponds to the length of the gaps 21*d*, 20*d* between the U-shaped discharge vessels 21, 20, respectively, in which they are positioned. Both of the flaps 19*a*, 19*b* are so located, and their crease lines 26*a*, 26*b* are so positioned with respect to the discharge lamp units within the box formed by the panel 1, that the respective flaps 19*a*, 19*b* do not extend essentially parallel to the side wall panels 5, 6 but, when the box is erected, see FIG. 2B, form an angle therewith. This angle, for example, can be about 70° with respect to the bottom wall panel 2. It is not critical, but should be suitably selected so that both of the legs 20*a*, 20*b* and 21*a*, 21*b* of any one of the units are engaged by the respective retention flap 19*b*, 19*a*.

The blank 1, thus, has respective retention flaps which engage between the respective gaps 20*d*, 21*d* of the discharge vessel units 20, 21 of the lamp. An additional flap can be provided to engage between the lamp units themselves, that is, in the gap 2021*d*.

In accordance with a feature of the invention, the bottom wall panel 2, at one end thereof, has a protective extension flap 9 formed thereon. The flap 9 is coupled to the bottom panel 2 by a crease line 10. The protective flap can be folded back upon itself to engage behind the contact pins 11, 11', when the box is erected. The protective flap 9, in use, will clamp behind the contact pins 11, 11'. The protective flap 9, in order to protect the entire length of the pins, when folded back against the base, is longer than the projection of the pins 11, 11' extending from the lamp L.

Figure 3:
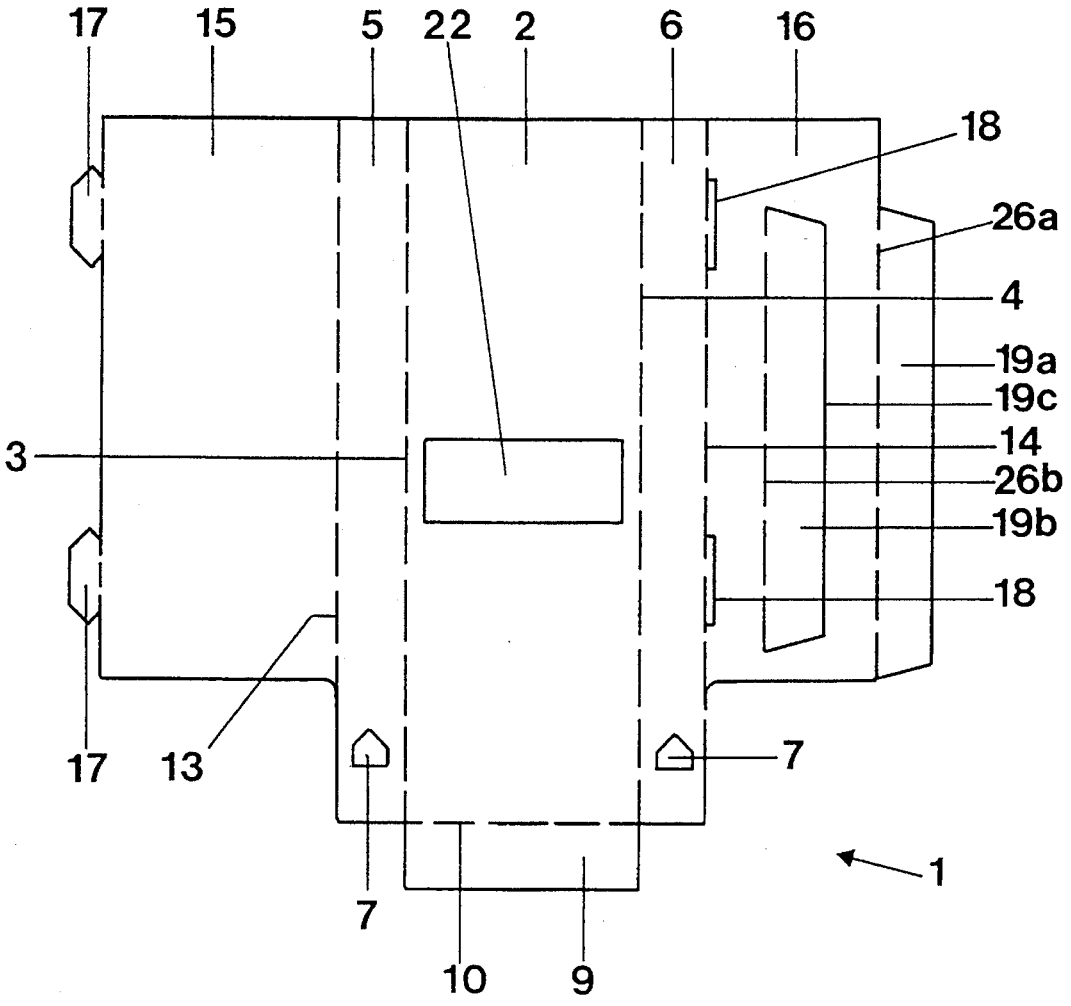
FIG. 3 is a plan view of another embodiment of a carton blank suitable for retaining the lamp of FIG. 1.

FIG. 3 illustrates another example of the box for the lamp L of FIG. 1A. It differs from the example described in connection with FIGS. 2A and 2B only in that a window 22 is cut into the bottom wall panel 2. The window 22 is located roughly in the center of the bottom wall panel 2. A suitable size is about 6×2 cm. The legs 20*a*, 20*b*, 21*a*, 21*b* of the discharge vessel units 20, 21 can be inspected through the window 22. The units 20, 21, preferably, are located in a single plane, next to each other.

Various changes and modifications may be made. For example, by additional minor modifications, folded fluorescent lamps with more than two discharge units, similar to units 20, 21, can be packaged. In order not to unduly weaken the box, the flap 19*b* can be formed in two axially or vertically extending—with respect to FIG. 2A—portions.

We claim:

1. The combination of a box (1') with a single-based, folded fluorescent lamp (L), wherein said fluorescent lamp (L) has at least two U-shaped discharge units (20; 21) located adjacent each other, each unit (20; 21) defining two legs (20*a*, 20*b*; 21*a*, 21*b*), one connecting portion (20*c*; 21*c*), and a gap (20*d*, 21*d*) between the legs of each unit, said lamp defining a further gap (2021*d*) between the legs of adjacent units, wherein said box has essentially elongated rectangular block shape and is a unitary cardboard element constructed of a cardboard blank (1), said box comprising a top panel (15);

a bottom panel (2);

an intermediate panel (16) extending parallel to the top panel (15) and having a width which is less than the width of the top panel (15);

two side panels (5, 6) located at respective lateral sides of the box, extending at essentially right angles with respect to the bottom panel (2), a first one (5) of said side panels (5, 6) being connected to the top panel (15) and to the bottom panel (2) by respective fold lines (3, 13);

a second one (6) of said side panels (5, 6) being connected to the intermediate panel (16) by an intermediate panel fold line (14) and to the bottom panel (2) by a bottom panel fold line (4);

a first retention flap (19*a*) unitary with the intermediate panel (16), bent along a first retention flap fold line (26*a*) off an end region of the intermediate panel (16), extending at an angle therefrom, and projecting in the gap (21*d*) between two of said legs (21*a*, 21*b*) of one (21) of said units of the lamp (L), and a second retention flap (19*b*) unitary with said intermediate panel (16), and formed by an incision (19*c*) in the intermediate panel (16), connected to said intermediate panel at a second retention flap fold line (26*b*), and bent about said second retention flap fold line, away from said intermediate panel (16), said second retention flap (19*b*) projecting in the gap (20*d*) between two of said legs (20*a*, 20*b*) of another one (20) of said units of the lamp (L) to, in combination with said first retention flap (19*a*), absorb vibrations and deflections of the lamp (L) during transport and handling.

2. The combination of claim 1, wherein at least one of the first retention flap (19*a*) and the second retention flap (19*b*) forms an angle of less than 90° with respect to the bottom panel (2).

3. The combination of claim 1, wherein both retention flaps (19*a*, 19*b*) form an angle of less than 90° with respect to the bottom panel (2).

4. The combination of claim 1, wherein the lamp includes a base (21) and projecting connecting pins (11, 11');

wherein the bottom panel (2) includes a pin protective flap (9) integral with said bottom panel, and formed with an extension fold line (10) intermediate the length of said pin protective flap (9);

wherein said pin protective flap (9) is folded back towards the box along the extension fold line (10), the terminal portion of said pin protective flap being fitted beneath said connecting pins (11, 11') for supporting said connecting pins and said base, and being prevented from escape by said connecting pins; and wherein the length of the pin protective flap, after folding, is longer than the length of said pins (11, 11') projecting from the lamp.

5. The combination of claim 1, wherein the top panel (15) includes closing tabs (7) projecting from an edge thereof; and wherein engagement slits (8) are formed at a fold line between one of the side walls (6) and the intermediate panel (16), which slits are dimensioned and shaped to receive said closing tabs.

6. The combination of claim 1, wherein the bottom panel is formed with at least one inspection opening (22).

7. The combination of claim 1, wherein said cardboard element of said box comprises corrugated cardboard.

* * * * *